United States Patent [19]

Vanier et al.

[11] Patent Number: 4,716,144

[45] Date of Patent: Dec. 29, 1987

[54] DYE-BARRIER AND SUBBING LAYER FOR DYE-DONOR ELEMENT USED IN THERMAL DYE TRANSFER

[75] Inventors: Noel R. Vanier, Rochester; Kin K. Lum, Webster; Wayne A. Bowman, Walworth, all of N.Y.

[73] Assignee: Eastman Kodak Company, Rochester, N.Y.

[21] Appl. No.: 934,969

[22] Filed: Nov. 25, 1986

Related U.S. Application Data

[63] Continuation-in-part of Ser. No. 813,294, Dec. 24, 1985, abandoned.

[51] Int. Cl.[4] ..... B41M 5/26

[52] U.S. Cl. ..... 503/227; 8/471; 427/146; 427/256; 428/195; 428/480; 428/483; 428/500; 428/522; 428/532; 428/913; 428/914; 430/945

[58] Field of Search ..... 8/470, 471; 346/227; 427/146, 256; 428/195, 207, 480, 913, 914, 341, 483, 500, 522, 532

[56] References Cited

U.S. PATENT DOCUMENTS

| | | | |
|---|---|---|---|
| 4,021,591 | 5/1977 | DeVries et al. | 428/914 |
| 4,027,345 | 6/1977 | Fujisawa et al. | 428/913 |
| 4,253,838 | 3/1981 | Mizuno et al. | 8/471 |

FOREIGN PATENT DOCUMENTS

| | | | |
|---|---|---|---|
| 109295 | 5/1984 | European Pat. Off. | 8/471 |
| 138483 | 4/1985 | European Pat. Off. | 428/914 |
| 19138 | 1/1985 | Japan | 346/227 |

*Primary Examiner*—Bruce H. Hess
*Attorney, Agent, or Firm*—Harold E. Cole

[57] ABSTRACT

A dye-donor element for thermal dye transfer comprising a support having on one side thereof a dye layer and on the opposite side thereof a slipping layer comprising a lubricating material, and wherein a hydrophilic dye-barrier layer is located between the dye layer and the support, and a subbing layer is located between the dye-barrier layer and the support. The dye-barrier layer prevents wrong-way transfer of dye into the support which provides improved dye transfer densities. The subbing layer improves adhesion between the dye-barrier layer and the support.

20 Claims, No Drawings

DYE-BARRIER AND SUBBING LAYER FOR DYE-DONOR ELEMENT USED IN THERMAL DYE TRANSFER

This application is a continuation-in-part of U.S. application Ser. No. 813,294, filed Dec. 24, 1985 now abandoned.

This invention relates to dye-donor elements used in thermal dye transfer, and more particularly to the use of a dye-barrier layer and a subbing layer to provide improved dye transfer densities.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor elememt is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

Dye layers which are coated directly on a support for a dye-donor element for thermal dye transfer printing, such as poly(ethylene terephthalate), experience loss of dye by uncontrolled non-directionalized diffusion into the support during the transfer process. The dye-donor support softens during heating and has the inherent property to act as a receiver for the dye. Dye which is lost by this wrong way diffusion results in less dye being transferred to the dye-receiving element. Since the background density in a thermal dye transfer system is essentially constant, any increase in density of the transferred dye in image areas results in improved discrimination, which is highly desirable.

In Japanese patent publication number 19,138/85, an image-receiving element for thermal dye transfer printing is disclosed. In Example 3 of that publication, a dye-donor element is also described which indicates that a gelatin subbing layer of 2 g/m$^2$ is located between the dye layer and the support. It would be desirable to increase the dye density obtained by such elements.

In European patent application No. 109,295, there is a disclosure of a dye-donor sheet with a "prime coating" thereon such as a polycarbonate or a polyester. These prime coatings are hydrophobic materials and are said to melt when the sheet is heated. Since most dyes used for thermal printing are also hydrophobic, they would readily diffuse into such a layer, so that the dye available for transfer would decrease.

It would be desirable to provide a way to increase the density of the transferred dyes in a dye-donor element for thermal dye transfer and also to provide adequate adhesion between the dye layer and the support.

These and other objects are achieved by employing a dye-barrier layer and a subbing layer in accordance with this invention.

Thus, this invention relates to a dye-donor element for thermal dye transfer which comprises a support having on one side thereof a dye layer and on the opposite side thereof a slipping layer comprising a lubricating material, and wherein a hydrophilic dye-barrier layer is located between the dye layer and the support, and a subbing layer is located between the dye-barrier layer and the support. In a preferred embodiment of the invention, the dye-barrier layer is present from about 0.1 to about 1.6 g/m$^2$.

A hydrophilic material can function as a dye-barrier layer since most of the dyes used in thermal dye transfer printing are hydrophobic and have negligible affinity for or solubility in hydrophilic materials. Thus, the barrier layer functions to prevent wrong-way transfer of dye into the dye-donor support, with the result that the density of the transferred dye in increased.

The hydrophilic dye-barrier layer may contain any hydrophilic material which is useful for the intended purpose. In general, good results have been obtained with gelatin, poly(acrylamide), poly(isopropylacrylamide), butyl methacrylate graft on gelatin, ethyl acrylate graft on gelatin, ethyl methacrylate graft on gelatin, cellulose monoacetate, methyl cellulose, poly(vinyl alcohol), poly(ethyleneimine), poly(acrylic acid), a mixture of poly(vinyl alcohol) and poly(vinyl acetate), a mixture of poly(vinyl alcohol) and poly(acrylic acid) or a mixture of cellulose monoacetate and poly(acrylic acid). In a particularly preferred embodiment of the invention, poly(acrylic acid), cellulose monoacetate or poly(vinyl alcohol) are employed.

Any subbing material may be used in the invention as long as it performs the desired function. In a preferred embodiment, good results have been obtained with poly(acrylonitrile-co-vinylidene chloride-co-acrylic acid), (14:80:6 wt. ratio), poly(butyl acrylate-co-2-aminoethyl methacrylate-co-2-hydroxyethyl methacrylate), (30:20:50 wt. ratio), a linear saturated polyester, such as Bostik 7650® (Emhart Corp., Bostik Chem. Group) or a chlorinated high density poly(ethylenetrichloroethylene) resin. The subbing layer may be coated in any amount which is effective for the desired function. In general, good results are obtained at coverages from about 0.1 to about 2.0 g/m$^2$.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KB® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

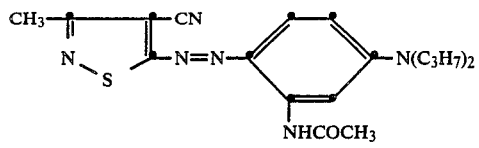

(magenta)

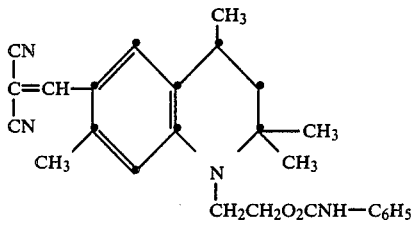

(yellow)

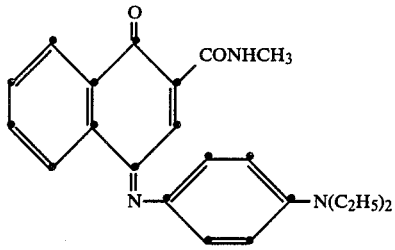

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylontrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 2 to about 30 $\mu$m.

The reverse side of the dye-donor element is coated with a slipping layer to prevent the printing head from sticking to the dye-donor element. Such a slipping layer comprises a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone, carbowax or poly(ethylene glycols). Suitable polymeric binders for the slipping layer include poly(vinyl alcohol butyral), poly(vinyl alcohol acetal), poly(styrene), poly(vinyl acetate), cellulose acetate butyrate, cellulose acetate, or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

The dye-receiving element that is used with the dye-donor element of the invention usually comprises a support having thereof a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as duPont Tyvek ®. In a preferred embodiment, polyester with a white pigment incorporated therein is employed.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only one dye thereon or may have alternating areas of different dyes, such as sublimable cyan, magenta, yellow, black, etc., as described in U.S. Pat. No. 4,541,830. Thus, one-, two- three- or four-color elements (or higher numbers also) are included within the scope of the invention.

In a preferred embodiment of the invention, the dye-donor element comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCS001), a TDK Thermal Head F415 HH-b 7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

Various Dye-Barrier Layers

The dye-donor element is prepared by coating the following layers in the order recited on a 6 μm poly(ethylene terephthalate) support:

(1) Subbing layer of poly(acrylonitrile-co-vinylidene chloride-co-acrylic acid), (14:80:6 wt. ratio), (2) Dye-barrier layer of the material indicated in Table 1, and (3) Dye layer containing the following magenta dye in a binder as specified:

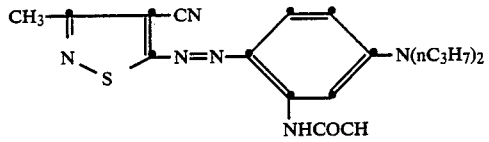

The back of each dye-donor element was coated with a slipping layer of either (a) beeswax (0.54 g/m$^2$) in a binder of cellulose acetate butyrate (14% acetyl, 37% butyryl) (0.54 g/m$^2$) or (b) poly(vinyl stearate) (0.30 g/m$^2$) in a binder of poly(vinyl alcohol-co-butyral) (0.45 g/m$^2$).

For control element 1 and elements A and B of the invention, the dye layer consisted of 0.15 g/m$^2$ magenta dye, 0.15 g/m$^2$ 2-ethyl-2-hydroxymethyl-1,3-propanediol and 0.54 g/m$^2$ high viscosity cellulose acetate coated from tetrahydrofuran.

For control elements 2 and 4–7, and elements C, D, and F-W of the invention, the dye layer consisted of 0.22 g/m$^2$ magenta dye and 0.39 g/m$^2$ cellulose acetate hydrogen phthalate (18 to 21% acetyl, 32–36% phthalyl) coated from 8% cyclohexanone and 11% acetone in 2-butanone.

For control element 3 and element E of the invention, the dye layer consisted of 0.14 g/m$^2$ magenta dye and 0.54 g/m$^2$ high viscosity cellulose acetate coated from 8% cyclohexanone and 11% acetone in 2-butanone.

Dye-receiving elements

For control donor elements 1 and 3 and elements A, B, and E of the invention, the dye-receiving element consisted of a reflective paper support having a waterproof poly(ethylene)-titanium dioxide overcoat which was coated with a dye image-receiving layer comprising 4.8 g/m$^2$ of Uralac P-2504 ® (GCA Chemical Corporation) hydroxylated branched polyester resin.

For all other donor elements, 2.9 g/m$^2$ of Makrolon 5705 ® (Bayer AG) polycarbonate resin was coated on top of ICI Melinex 990 ® white polyester support from a dichloromethane and trichloroethylene solvent mixture.

The dye side of the dye-donor element strip 0.75 inches (19 mm) wide was placed in contact with the dye image-receiving layer of the dye-receiver element of the same width. The assemblage was fastened in the jaws of a stepper motor driven pulling device. The assemblage was laid on top of a 0.55 (14 mm) diameter rubber roller and a Fujitsu Thermal Head and was pressed with a spring at a force of 3.5 pounds (1.6 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive elements in the thermal print head were heated at 0.5 msec increments from 0 to 4.5 msec to generate a graduated density test pattern. The voltage supplied to the print head was approximately 19 v representing approximately 1.75 watts/dot. Estimated head temperature was 250°–400° C.

The assemblage was separated, the dye-donor element was discarded, and the dye transferred to the dye-receiver element was measured with an X-Rite 338 Color Reflection Densitomer ® with Status A filters. The following results were obtained:

TABLE 1

| Element | Barrier Layer | Barrier Layer Coverage (g/m$^2$) | Dye Layer Conc. (g/m$^2$) | Receiving Layer | Status A D-max |
|---|---|---|---|---|---|
| Control 1 | None (Control) | — | 0.15 | Polyester | 0.80 |
| A | Methyl Cellulose (Eastman 15718) ® (mw 3500–5600) | 0.28 | 0.15 | Polyester | 0.92 |
| B | Gelatin A non-deionized, non-volatile, acid-base manufacture photographic grade bone gelatin | 1.1 | 0.15 | Polyester | 0.95 |
| Control | None (Control) | — | 0.22 | Polycarbonate | 1.9 |

TABLE 1-continued

| Element | Barrier Layer | Barrier Layer Coverage ($g/m^2$) | Dye Layer Conc. ($g/m^2$) | Receiving Layer | Status A D-max |
|---|---|---|---|---|---|
| 2 | | | | | |
| C | Gelatin (as B above) | 0.43 | 0.22 | Polycarbonate | 2.1 |
| D | Poly(vinyl alcohol) (Eastman 2606) ® (99–100% hydrolyzed) | 0.43 | 0.22 | Polycarbonate | 2.3 |
| Control 3 | None (Control) | — | 0.14 | Polyester | 1.2 |
| E | A mixture of poly-(vinyl alcohol) (Air Products-Vinol 523 ®) (87% hydrolyzed) plus 20% poly(vinyl acetate) latex | 0.81 | 0.14 | Polyester | 1.4 |
| Control 4 | None (Control) | — | 0.22 | Polycarbonate | 1.6 |
| F | Gelatin (as B above) | 0.43 | 0.22 | Polycarbonate | 1.9 |
| G | Poly(vinyl alcohol) (as D above) | 0.43 | 0.22 | Polycarbonate | 1.9 |
| H | Poly(vinyl alcohol) (Air Products-Vinol 523 ®) (87% hydrolyzed) | 0.43 | 0.22 | Polycarbonate | 1.8 |
| I | Poly(ethyleneimine) (Mica Corp.-Mica A131X ®) | 0.43 | 0.22 | Polycarbonate | 1.8 |
| J | Poly(acrylic acid) | 0.43 | 0.22 | Polycarbonate | 1.9 |
| Control 5 | None | — | 0.22 | Polycarbonate | 1.8 |
| K | Gelatin (as B above) | 0.43 | 0.22 | Polycarbonate | 2.4 |
| L | Poly(vinyl alcohol) (as D above) | 0.43 | 0.22 | Polycarbonate | 2.4 |
| M | Butyl methacrylate graft on gelatin (B above) (1:4 gel) | 0.43 | 0.22 | Polycarbonate | 2.1 |
| N | Ethyl acrylate graft on gelatin (B above) (1:4 gel) | 0.43 | 0.22 | Polycarbonate | 2.3 |
| O | Ethyl methacrylate graft on gelatin (B above) (1:4 gel) | 0.43 | 0.22 | Polycarbonate | 2.5 |
| Control 6 | None (Control) | — | 0.22 | Polycarbonate | 1.8 |
| P | Poly(vinyl alcohol) (as D above) | 0.43 | 0.22 | Polycarbonate | 2.2 |
| Q | A mixture of poly(vinyl alcohol) and 20% poly(vinyl acetate) (as E above) | 0.43 | 0.22 | Polycarbonate | 2.4 |
| R | Cellulose monoacetate (partially acetylated cellulose, water soluble) | 0.43 | 0.22 | Polycarbonate | 2.4 |
| S | Poly(acrylic acid) (as J above) | 0.43 | 0.22 | Polycarbonate | 2.1 |
| T | Mixture of cellulose monoacetate (R above) and equal weight of poly(acrylic acid) (J above) | 0.43 | 0.22 | Polycarbonate | 2.2 |
| Control 7 | None (Control) | — | 0.22 | Polycarbonate | 1.8 |
| U | Mixture of poly(vinyl alcohol) (D above) and equal weight of poly(acrylic acid) (J above) | 0.22 | 0.22 | Polycarbonate | 2.0 |
| V | Mixture of poly(vinyl alcohol) (D above) and equal weight of poly(acrylic acid) (J above) | 0.43 | 0.22 | Polycarbonate | 2.1 |
| W | Mixture of poly(vinyl alcohol) (D above) and equal weight of poly(acrylic acid) | 1.1 | 0.22 | Polycarbonate | 2.0 |

TABLE 1-continued

| Element | Barrier Layer | Barrier Layer Coverage ($g/m^2$) | Dye Layer Conc. ($g/m^2$) | Receiving Layer | Status A D-max |
|---|---|---|---|---|---|
| | (J above) | | | | |

The results indicate that the dye-barrier layer of the invention is effective to significantly increase D-max as compared to the control without any dye-barrier layer.

EXAMPLE 2

Various Dye-Barrier Layers (A) A dye-donor element according to the invention was prepared by coating the following layers in the order recited on a 6 μm poly(ethylene terephthalate) support:

(1) Subbing layer of poly(acrylonitrile-co-vinylidene chloride-co-acrylic acid) (14:80:6 wt. ratio) at either 0.11 $g/m^2$ or 0.43 $g/m^2$ coated from a butanone and cyclopentanone (95:5) solvent mixture, (2) Dye-barrier layer as indicated in Table 2 (0.16 $g/m^2$) coated from water, and (3) Dye layer containing the following magenta dye (0.17 $g/m^2$) in a cellulose acetate propionate binder (2.5% acetyl, 45% propionyl) (0.34 $g/m^2$) coated from a toluene and methanol (80:20) solvent mixture:

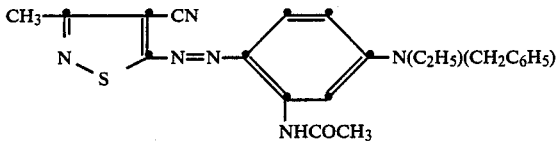

On the back side of the element was coated a slipping layer of Gafac RA600® (GAF Corp.), a complex phosphate mono- and di-ester nonionic surfactant (0.032 $g/m^2$) in a poly(styrene-co-acrylonitrile) (70:30 wt. ratio) binder (0.58 $g/m^2$) coated from a tetrahydrofuran:cyclopentanone (90:10) solvent mixture.

(B) A control element was prepared similar to (A), except that it has no dye-barrier or subbing layer.

(C) Another control element was prepared similar to (A), except that it had a subbing layer but no barrier layer.

A dye-receiving element was prepared by coating a solution of Makrolon 5707® (Bayer AG) polycarbonate resin (2.9 $g/m^2$) and release agent FC-431® (3M Corp.) (40 $mg/m^2$) on an ICI Melinex 990® white polyester support from a methylene chloride and trichloroethylene solvent mixture.

The dye side of the dye-donor element strip one inch (25 mm) wide was placed in contact with the dye image-receiving layer of the dye-receiver element of the same width. The assemblage was fastened in the jaws of a stepper motor driven pulling device.

The assemblage was laid on top of a 0.55 (14 mm) diameter rubber roller and a TDK Thermal Head L-133 (No. C6-0242) and was pressed with a spring at a force of 8 pounds (3.6 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive elements in the thermal print head were pulse-heated for approximately 8 msec to generate a maximum density image. The voltage supplied to the print head was approximately 22 v representing approximately 1.5 watts/dot (12 mjoules/dot) for maximum power.

The dye-receiver was separated from each dye-donor and the green status A reflection maximum density was read.

Each dye-donor element was also subjected to a tape adhesion test. A small area (approximately ½ inch×2 inches) of 3M Highland® 6200 Permanent Mending Tape was firmly pressed by hand to the top dye layer of a dye-donor element leaving enough urea free to serve as a handle for pulling the tape. Upon manually pulling the tape, none of the dye layer with adjacent barrier layer would be removed in an ideal situation. When dye layer was removed, this indicated a weak bond between the support and the coated layers. An effective subbing layer would prevent such dye layer removal onto the tape as invariably the bonds between the other layers were stronger.

The following categories were established:

E—excellent (no dye layer removal)

G—good (negligible quantities and areas of dye layer removal)

F—fair (small quantities and areas of dye layer removal

P—poor (substantial areas of dye layer removal)

U—unacceptable (dye layer completely removed)

The following results were obtained:

TABLE 2

| Barrier Layer ($g/m^2$) | Status A D max | Tape Test |
|---|---|---|
| Subbing Layer @ 0.11 $g/m^2$ | | |
| none (control)* | 2.4 | U |
| none (control) | 2.2 | E |
| poly(acrylic acid) | 2.6 | F |
| poly(vinyl alcohol) (100% hydrolyzed) | 3.0 | F |
| poly(acrylamide) | 2.7 | G |
| poly(isopropylacrylamide) | 2.2 | F |
| poly(vinyl alcohol):Ludox AM ® (an aluminum modified colloidal silica (1:1) | 2.9 | F |
| cellulose monoacetate (as R in Example 1) | 3.0 | F |
| gelatin (as B in Example 1) | 3.0 | F |
| butyl methacrylate graft on gelatin (1:4 gel) | 2.4 | E |
| ethyl acrylate graft on gelatin (1:4 gel) | 2.3 | E |
| ethyl methacrylate graft on gelatin (1:4 gel) | 2.7 | G |
| Subbing Layer @ 0.43 $g/m^2$ | | |
| none (control)* | 2.4 | U |
| none (control) | 1.5 | E |
| poly(acrylic acid) | 2.7 | F |
| poly(vinyl alcohol) (100% hydrolyzed) | 3.0 | F |
| poly(acrylamide) | 2.8 | G |
| poly(isopropylacrylamide) | 1.5 | F |
| poly(vinyl alcohol):Ludox AM ® (an aluminum modified colloidal silica (1:1) | 2.9 | F |
| cellulose monoacetate (as R in Example 1) | 2.8 | F |
| gelatin (as B in Example 1) | 2.5 | F |

*No subbing layer either.

The above results indicate that although dye transfer was acceptable without the use of a dye-barrier layer or subbing layer, the adhesion was unacceptable. When only a subbing layer was used, the adhesion was acceptable, but the transferred dye density was low. The combination of both the dye-barrier layer and subbing layer minimized both problems.

EXAMPLE 3

Various Subbing Layers

Dye-receiving elements were prepared as in Example 2.

A dye-donor element according to the invention was prepared by coating the following layers in the order recited on a 6 μm poly(ethylene terephthalate) support:

(1) Subbing layer as indicated in Table 3 at either 0.11 or 0.43 g/m$^2$ coated from butanone and cyclopentanone (95:5) solvent mixture, (2) Dye-barrier layer of poly(vinyl alcohol) (0.16 g/m$^2$) coated from water, and (3) Dye layer as in Example 2.

A slipping layer was also coated on the back of the element as in Example 2.

The following subbing layer materials were employed:

(A) poly(acrylonitrile-co-vinylidene chloride-co-acrylic acid), (14:80:6 wt. ratio), (B) poly(butyl acrylate-co-2-aminoethyl methacrylate-co-2-hydroxyethyl methacrylate), (30:20:50 wt. ratio), (C) Bostik 7650® linear saturated polyester (Emhart Corp., Bostik Chem. Group), and (D) a chlorinated high density poly(ethylene-trichloroethylene) resin.

Control dye-donors were also prepared without a barrier layer and without a subbing layer as indicated in Table 3.

The dye-donors and dye-receivers were used to generate a graduated density test object in the manner described in Example 2, except that the resistive elements in the thermal print head were pulse-heated in increments from 0 to 8.3 msec. The dye-receiver was manually separated from each dye-donor. If no dye-donor stuck to the dye-receiver, separation was considered excellent (E). If any portion of the dye-donor stuck to the dye-receiver, separation was considered unacceptable (U). Status A green reflection densities were also read to determine the effectiveness of the barrier layer.

The following results were obtained:

TABLE 3

| Subbing Layer | PVA Barrier Layer | Status A D-max | Receiver Separation |
|---|---|---|---|
| | Subbing Layer @ 0.11 g/m$^2$ | | |
| None | No | 2.0 | U |
| None | Yes | 2.5 | U |
| A | No | 2.0 | — |
| A | Yes | 2.5 | E |
| B | No | 2.0 | — |
| B | Yes | 2.5 | E |
| C | No | 1.6 | — |
| C | Yes | 2.1 | E |
| D | No | 1.6 | — |
| D | Yes | 1.9 | E |
| | Subbing Layer @ 0.43 g/m$^2$ | | |
| None | No | 2.0 | U |
| None | Yes | 2.5 | U |
| A | No | 1.7 | — |
| A | Yes | 2.6 | E |
| B | No | 1.6 | — |
| B | Yes | 2.6 | E |
| C | No | 1.5 | — |
| C | Yes | 2.4 | E |
| D | No | 2.0 | — |
| D | Yes | 2.2 | E |

The above results indicate that the inclusion of a poly(vinyl alcohol) barrier layer improved the maximum density transferred. Without a subbing layer, the adhesion was unacceptable. The inclusion of any one of the subbing layers with the barrier layer gave both good transferred density and adhesion. The greater improvement in transferred density was obtained with the higher level of subbing material.

EXAMPLE 4

Varying amounts of Subbing Layer

Dye-receiving elements were prepared as in Example 2.

A dye-donor element according to the invention was prepared by coating the following layers in the order recited on a 6 μm poly(ethylene terephthalate) support:

(1) Subbing layer of poly(acrylonitrile-co-vinylidene chloride-co-acrylic acid) (14:80:6 wt. ratio) (0.11 g/m$^2$) coated from a butanone and cyclopentanone (95:5) solvent mixture, (2) Dye-barrier layer of poly(vinyl alcohol) coated from water and having the concentration specified in Table 4, and (3) Dye layer as in Example 2.

A slipping layer was also coated on the back of the element as in Example 2.

The same evaluation procedure was used as in Example 2. The following results were obtained:

TABLE 4

| Poly(vinyl alcohol) Subbing Layer (g/m$^2$) | Status A D-max |
|---|---|
| None* (control) | 1.5 |
| 0.11* (control) | 1.5 |
| 0.11 | 1.8 |
| 0.22 | 2.1 |
| 0.43 | 2.0 |
| 0.86 | 2.1 |
| 1.6 | 2.1 |

*No barrier layer either.

The above results indicate that although as little as 0.1 g/m$^2$ poly(vinyl alcohol) functioned as a barrier layer, the greatest improvement in transferred dye density was obtained at greater concentrations. There were no adhesion problems for coatings in this experiment.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a support having on one side thereof a dye layer and on the opposite side thereof a slipping layer comprising a lubricating material, the improvement wherein a hydrophilic dye-barrier layer is located between said dye layer and said support, and a subbing layer is located between said dye-barrier layer and said support.

2. The element of claim 1 wherein said dye-barrier layer is present in an amount of from about 0.1 to about 1.6 g/m$^2$.

3. The element of claim 1 wherein said hydrophilic polymer is gelatin, poly(acrylamide), poly(isopropylacrylamide), butyl methacrylate graft on gelatin, ethyl acrylate graft on gelatin, ethyl methacrylate graft on gelatin, cellulose monoacetate, methyl cellulose, poly(vinyl alcohol), poly(ethyleneimine), poly(acrylic acid), a mixture of poly(vinyl alcohol) and poly(vinyl acetate), a mixture of poly(vinyl alcohol) and poly(acrylic acid), or a mixture of cellulose monoacetate and poly(acrylic acid).

4. The element of claim 1 wherein said dye layer comprises a sublimable dye in a binder.

5. The element of claim 1 wherein said hydrophilic polymer is poly(acrylic acid), cellulose monoacetate or poly(vinyl alcohol).

6. The element of claim 1 wherein said subbing layer is poly(acrylonitrile-co-vinylidene chloride-co-acrylic acid), poly(butyl acrylate-co-2-aminoethyl methacrylate-co-2-hydroxyethyl methacrylate), a linear saturated polyester, or a chlorinated high density poly(ethylene-trichloroethylene) resin.

7. The element of claim 1 wherein said support comprises poly(ethylene terephthalate) and said subbing layer comprises poly(acrylonitrile-co-vinylidene chloride-co-acrylic acid).

8. The element of claim 7 wherein said dye layer comprises sequential repeating areas of cyan, magenta and yellow dye.

9. In a process of forming a dye transfer image comprising imagewise-heating a dye-donor element comprising a support having on one side thereof a dye layer and on the opposite side thereof a slipping layer comprising a lubricating material and transferring a dye image to a dye-receiving element to form said dye transfer image, the improvement wherein a hydrophilic dye-barrier layer is located between said dye layer and said support, and a subbing layer is located between said dye-barrier layer and said support.

10. The process of claim 9 wherein said dye-barrier layer is present in an amount of from about 0.1 to about 1.6 g/m$^2$.

11. The process of claim 9 wherein said hydrophilic polymer is poly(acrylic acid), cellulose monoacetate or poly(vinyl alcohol).

12. The process of claim 9 wherein said support is poly(ethylene terephthalate) which is coated with sequential repeating areas of cyan, magenta and yellow dye and said subbing layer comprises poly(acrylonitrile-co-vinylidene chloride-co-acrylic acid), and said process steps are sequentially performed for each color to obtain a three-color dye transfer image.

13. In a thermal dye transfer assemblage comprising:

(a) a dye-donor element comprising a support having on one side thereof a dye layer and on the opposite side thereof a slipping layer comprising a lubricating material, and (b) a dye-receiving element comprising a support having thereon a dye image-receiving layer, said dye-receiving element being in a superposed relationship with said dye-donor element so that said dye layer is in contact with said dye image-receiving layer, the improvement wherein a hydrophilic dye-barrier layer is located between said dye layer and said support, and a subbing layer is located between said dye-barrier layer and said support.

14. The assemblage of claim 13 wherein said dye-barrier layer is present in an amount of from about 0.1 to about 1.6 g/m$^2$.

15. The assemblage of claim 13 wherein said hydrophilic polymer is methyl cellulose, gelatin, poly(acrylamide), poly(isopropylacrylamide), cellulose monoacetate, poly(vinyl alcohol), a mixture of poly(vinyl alcohol) and poly(vinyl acetate), poly(ethyleneimine), poly(acrylic acid), a mixture of poly(vinyl alcohol) and poly(acrylic acid), a mixture of cellulose monoacetate and poly(acrylic acid), butyl methacrylate graft on gelatin, ethyl acrylate graft on gelatin, or ethyl methacrylate graft on gelatin.

16. The assemblage of claim 13 wherein said dye layer comprises a sublimable dye in a binder.

17. The assemblage of claim 13 wherein said hydrophilic polymer is poly(acrylic acid), cellulose monoacetate or poly(vinyl alcohol).

18. The assemblage of claim 13 wherein said subbing layer is poly(acrylonitrile-co-vinylidene chloride-co-acrylic acid), poly(butyl acrylate-co-2-aminoethyl methacrylate-co-2-hydroxyethyl methacrylate), a linear saturated polyester, or a chlorinated high density poly(ethylene trichloroethylene) resin.

19. The assemblage of claim 13 wherein said support of the dye-donor element comprises poly(ethylene terephthalate) and said subbing layer comprises poly(acrylonitrile-co-vinylidene chloride-co-acrylic acid).

20. The assemblage of claim 19 wherein said dye layer comprises sequential repeating areas of cyan, magenta and yellow dye.

* * * * *